US006039189A

United States Patent [19]

Luke

[11] Patent Number: 6,039,189

[45] Date of Patent: Mar. 21, 2000

[54] MINERAL SOLIDS SEPARATION PROCESSES

[75] Inventor: Don Luke, Valrico, Fla.

[73] Assignee: Ciba Specialty Chemicals Water Treatments Limited, Bradford, United Kingdom

[21] Appl. No.: 09/116,806

[22] Filed: Jan. 28, 1998

Related U.S. Application Data

[60] Provisional application No. 60/036,766, Jan. 28, 1997.

[51] Int. Cl.[7] ..... B03B 1/00

[52] U.S. Cl. ..... 209/5; 209/166

[58] Field of Search ..... 209/5, 162, 166, 209/165; 8/650

[56] References Cited

U.S. PATENT DOCUMENTS

| | | | |
|---|---|---|---|
| 4,147,567 | 4/1979 | Block et al. | 148/6.15 Z |
| 4,285,695 | 8/1981 | Doerr et al. | 8/650 |

*Primary Examiner*—Kenneth W. Noland
*Attorney, Agent, or Firm*—David R. Crichton

[57] ABSTRACT

Surface solids formation during sedimentation of a flocculated mineral suspension is minimised by flocculating the suspension with flocculating agent in the presence of surfactant, provided that the flocculating agent and surfactant are not counterionic.

16 Claims, No Drawings

MINERAL SOLIDS SEPARATION PROCESSES

CROSS REFFERENCE TO RELATED APPLICATIONS

This application is an application filed under 35 U.S.C. §111(a) claiming benefit pursuant to 35 U.S.C. §119(e)(i) of the filing date of the Provisional Application 60/036,766, filed Jan. 28, 1997, pursuant to 35 U.S.C. §111(b).

BACKGROUND TO THE INVENTION

This invention relates to processes in which suspended solids in a mineral suspension, usually an aqueous mineral suspension, are separated by sedimentation. In particular it relates to such processes in which the sedimentation is conducted in such a manner as to prevent a layer of solids such as a thick crust forming on the upper surface of the suspension, and the apparatus containing it, during the sedimentation process.

Sedimentation processes for suspended solids in mineral suspensions are well known and conventionally are promoted by the addition of a flocculating agent. Sometimes a significant amount of fines or other material remains or accumulates on the surface of the suspension, often as a thick crust, during the flocculation and sedimentation. This occurs particularly when the suspension has been produced at least partially from a flotation process.

A particular problem arises when the suspension in one which is generated in the recovery of phosphate from a phosphate clay mineral. During this process phosphate values are separated from phosphate clay ores in various initial separation processes to separate the clay fraction from the phosphate and quartz sand fractions. The enriched phosphate fraction is subjected to further processing which results in the generation of additional clay waste, and is then subjected to one or more stages of preferential flotation. In this flotation stage the reject fraction containing primarily quartz sand solids, is often called the "tailings". The accept fraction contains phosphate values. During the flotation processes, the fraction containing phosphate values is subjected to various washing stages. During these washing stages flotation reagents are washed or stripped from the phosphate rich fraction and the residual reagents and associated wash water are combined with the collective clay waste suspensions from different stages of the phosphate recovery process. The combined suspension is then subjected to sedimentation for disposal of the clay solids and for reuse of the aqueous phase. However, clay solids and spent flotation reagents tend to form a thick crust (which can be up to 12 inches thick) on the surface of the suspension during the sedimentation process. As a result clay solids tend to be carried into the overflow water rather than remaining in the underflow. This means that the overflow water cannot be recycled directly into the plant without the risk of causing poor performance in one or more of the processes described above unless subjected to further treatment.

This surface solids formation has been a serious problem in various mineral sedimentation applications, in particular phosphate clay sedimentation, for many years and has not been solved.

Crust formation in other systems has been addressed in various ways. Anionic surfactants have been suggested for reducing surface crust formation in aqueous sodium hydrosulphite dye reducing compositions (in U.S. Pat. No. 4,285,695). Solutions for phosphating metal based sludges have been provided with alkali metal or ammonium lignosulphate additives to prevent crust formation on apparatus used for the phosphating process (in U.S. Pat. No. 4,147,567). However, neither of these involves separation of mineral solids from a suspension by sedimentation using an anionic flocculating agent.

In other processes which do not appear to present a problem with surface solids formation combinations of flocculant and surfactant have been used. For instance JP63/291700, JP61/204098, JP61/078499 and JP50/01967 disclose treatment of organic sludge from waste water treatment using flocculant and a surfactant. The inclusion of the surfactant in JP63/291700 is said to improve the handling properties of the flocculant. JP03/270780 describes a process of flotation of sludge in which surfactant and flocculant are added during the flotation process. JP62/298492 describes the addition of an inorganic salt (i.e., an inorganic coagulant) and a surfactant to a waste water dyeing solution. pH is adjusted to induce precipitation of materials from the solution and flocculant is added. The precipitate obtained is then separated from the solution.

However, none of these publications addresses the problem of surface solids formation in sedimentation processes for mineral suspensions which are treated with a flocculant to improve sedimentation.

OBJECT OF THE INVENTION

The object of the invention is to improve mineral solids separation processes during which surface solids tend to accumulate, in particular to improve underflow solids density and overflow clarity and to prevent or minimise formation of surface solids, in particular thick crusts.

SUMMARY OF THE INVENTION

According to the invention suspended solids in a mineral suspension are flocculated by adding to the suspension a flocculating agent and the flocculated suspension is then subjected to a sedimentation process, and in which surface solids formation during the sedimentation process is reduced or eliminated by adding surfactant to the suspension before or simultaneously with the flocculating agent, provided that the flocculating agent and surfactant are not counter-ionic.

We have found surprisingly that the inclusion of surfactant in the suspension either at the same time as or just before addition of the flocculating agent can significantly reduce and in some cases completely eliminate surface crusts which have been considered to be a major problem in some processes. In particular the invention can eliminate the very thick crusts which form on thickeners for sedimentation of phosphate clay containing suspensions.

Additionally, we have found that the inclusion of the surfactant can also improve the efficiency of the flocculant, in that lower doses of flocculant are required for equivalent sedimentation performance. Further, we find that the process can also lead to increased underflow solids density.

We also find that the process of the invention results in higher overflow clarity. Better overflow quality can provide benefits in the additional processes within the, system which use water recycled from the sedimentation process.

The invention also provides a composition which is an aqueous solution comprising from 0.01 to 5% of a copolymer of acrylamide and sodium acrylate and from 0.005 to 2% dialkyl sulphosuccinate surfactant.

This composition is particularly suitable for use in the process of the invention as a means for providing the flocculating agent and the surfactant when both are anionic.

DESCRIPTION OF PREFERRED EMBODIMENTS

The flocculating agent can be non-ionic, anionic or cationic. It can be any conventional flocculating agent of the types used for flocculating conventional mineral suspensions. Preferably the flocculating agent is anionic. Generally the flocculating agent is polymeric and is usually substantially water soluble. Often it is formed from ethylenically unsaturated monomer or monomer blend which provide the desired charge to the polymer.

If anionic, the flocculating agent can be any conventional anionic flocculating agent used for flocculating conventional mineral suspensions. Generally it is a polymeric flocculating agent, usually a substantially water-soluble polymer of an ethylenically unsaturated anionic monomer or monomer blend. Often it is a polymer of (meth) acrylic acid or other ethylenically unsaturated carboxylic acid, usually copolymerised with (meth) acrylamide. Thus copolymers of 5 to 10 wt % acrylic acid to 70 or 80 wt % acrylic acid with the balance being acrylamide are usually preferred. The acrylic acid is generally introduced as sodium acrylate or other salt.

The flocculant polymer typically has intrinsic viscosity of at least 4 dl/g, often 6 to 20 dl/g and sometimes as high as 30 or even 40 dl/g. In this specification intrinsic viscosity is measured using a suspended level viscometer at 25° C. on a solution in lN sodium chloride buffered to pH 7.

The amount of flocculant polymer can be any conventional, effective, flocculating amount. In the invention we find that it is possible to use amounts which are lower than those conventionally used and still obtain effective sedimentation and flocculation.

In particular reductions of about 10 to 15% in the amount of polymer used are often achieved.

Conventional dosages of flocculating agent are generally about 0.01 to about 1.0 lbs/ton (active flocculating agent on dry suspended solids), for instance about 0.1 to about 0.6 lbs/ton.

The surfactant can be anionic, cationic or non-ionic, provided that it and the flocculating agent are not counterionic. Therefore suitable combinations are anionic flocculant plus anionic surfactant, anionic flocculant plus non-ionic surfactant, non-ionic flocculant plus anionic surfactant, non-ionic flocculant plus non-ionic surfactant, non-ionic flocculant plus cationic surfactant, cationic flocculant plus non-ionic surfactant and cationic flocculant plus cationic surfactant.

Preferably the surfactant is anionic. Particularly preferably both the flocculant and the surfactant are anionic.

If anionic, the surfactant is preferably an ester of a sulphosuccinate. Usually it is a dialkyl sulphosuccinate. Preferably each alkyl group (independently) contains 6 to 12 carbon atoms. Preferably one or more alkyl groups is octyl. The preferred surfactant is dioctyl sulphosuccinate. The octyl groups may be normal or branched, for instance 2-ethylhexyl.

The surfactant should preferably be selected from materials which do not cause foaming during the process and so will generally be a low foaming or relatively non-foaming surfactant.

The amount of surfactant can be any amount which is effective for reducing or eliminating the formation of surface solids whilst allowing flocculation and sedimentation to occur.

Dosage of the surfactant is generally from about 0.001 to about 1 lbs/ton (active. surfactant on dry suspended solids) generally from about 0.005 to about 0.5 lbs ton. It can for instance be lower than 0.05 or even 0.0.3 lbs/ton.

The surfactant may be added together with a suitable solvent such as propylene glycol, lower alcohol or water.

The surfactant can be added to the suspension before the flocculating agent. Generally it is added only just before addition of the flocculating agent, generally not more than 5 or normally 1 minute before addition of the flocculating agent. Often it is added not more than 30 seconds before the flocculating agent.

In the invention it is important that the surfactant is present in the suspension at the moment when flocculating agent is added and flocculation occurs.

In some processes the suspension to be subjected to sedimentation is diluted before addition of flocculating agent by recirculating process water. In some processes the surfactant can be added to the process water which is then used to dilute the suspension and flocculating agent is then added to the diluted suspension.

Preferably the flocculating agent and surfactant are added to the suspension simultaneously, either separately or, preferably, as a single addition. Thus preferably a preformed blend of the flocculating agent and the surfactant is formed which is dosed into the suspension. In cases where the suspension is diluted before sedimentation, the preformed blend can be added either to the dilution water or to the diluted suspension after addition of the dilution water.

The preformed blend is generally a solution in water containing the flocculating agent and the surfactant. Dosing of the flocculant, surfactant and/or the preformed blend is usually in conventional manner for the addition of flocculating agent to a mineral suspension which is to be flocculated and sedimented.

It is particularly advantageous to provide the flocculant and the surfactant as a preformed solution in water. This is desirably produced in the make-up apparatus conventionally used for providing solutions of the flocculating agent. We find surprisingly that it is possible to add surfactant to the make-up apparatus together with the flocculant without inducing excessive foaming in the make-up apparatus, which would be expected to occur and to be disadvantageous.

The concentration of the flocculating agent in the preformed solution is preferably from 0.01 to 5%, more preferably 0.05 to 2%. The concentration of surfactant in the preformed mixed solution is preferably from 0.005 to 2%, more preferably from 0.005 to 1%. The preformed solution may be added, as discussed above, to the dilution water for the suspension. In this case, concentrations of the flocculating agent and surfactant in the dilution water will be reduced by a degree corresponding with the level of dilution.

The ratio of flocculating agent to surfactant, either in a preformed mixture or when the materials are added separately either at different times or simultaneously, is preferably from 1:1 to 50:1, in particular from 20:1 to 2:1 (by weight).

Suitable concentrations, dosages and ratios of flocculating agent and surfactant for any particular sedimentation process can be determined by experimentation.

The process in which the invention is used is one in which mineral solids are flocculated and allowed to sediment. Processes to which the invention can be applied are those in which, without the addition of the surfactant, surface solids tend to form. The invention reduces or eliminates the formation of surface solids. The surface solids may be mobile and may for instance include foam or they may form a thick crust of the type often observed during sedimentation of phosphate clay-containing residues. Some surface solids can form crusts from 2 to 15 inches thick, often 5 to 12 inches thick or greater.

A variety of mineral suspensions can be treated in accordance with the invention but the process is of particular value when the suspension is one which has been formed by a multiple stage separation process including a flotation stage. In particular the process is of value when the suspension is one which has been formed from the combined reject fractions of multiple process streams some of which may include residual flotation chemicals. Processes involving flotation may include washing stage(s), and the resultant wash water may contain spent or residual flotation chemicals. The wash water is typically combined with the various reject fractions from other washing and sizing operations, and thus the combined reject fraction contains spent or residual flotation chemicals. Other reject fractions which can be combined with wash water from a flotation stage include cyclone overflows and tank overflows. Thus an overall process according to the invention may involve subjecting an ore to multiple separation stages, some of which may include flotation, forming an enriched product stream, and a combined reject stream. The combined reject stream is then subjected to flocculation and sedimentation in accordance with the invention.

The process is of particular value when the suspended solids in the mineral suspension include clay solids and in particular when the mineral suspension is one which has been formed from the combined reject fractions of multiple process streams some of which may include residual flotation chemicals. An example of this can be found in a typical phosphate recovery process wherein the flotation chemicals are removed from the phosphate ore prior to subsequent treatment by washing. The wash water is typically combined with the various other reject fractions from other washing and sizing operations during phosphate recovery, and thus the combined reject fraction contains spent or residual flotation chemicals. It has been found that for many years sedimentation of the combined reject fraction leads to the formation of a thick crust on the surface of the sedimentation vessel, some of which contaminate the overflow of the sedimentation vessel. Such contamination of the overflow liquor is undesirable and causes performance in downstream operations to deteriorate, in particular flotation operations in which the overflow liquor is used in the flotation process itself.

Typical processes for the recovery of phosphate from phosphate ore rock, and to which the invention may be applied, are described in, for example, U.S. Pat. No. 3,622,087, U.S. Pat. No. 3,707,523 and U.S. Pat. No. 4,257,363.

The invention may also be applied to any process which shows a tendency to accumulate surface solids, in particular surface crust.

Other mineral suspensions to which the invention can be applied include gold concentrates. Thickeners for gold concentrate can give problems with floating solids which result in losses of gold values. Copper concentrate thickeners can also give problems with surface solids which can result in loss of copper values. Less preferably the invention can be applied to thickeners used in alumina production in the Bayer process.

The sedimentation and flocculation process may take place in a thickening tank (thickener). Alternatively, it may take place in a natural vessel such as a lagoon. If settlement takes place in a thickening tank flocculant and surfactant are generally added directly to the tank. If thickening takes place in a lagoon, flocculant and surfactant are generally added to the suspension as it is discharged to the lagoon.

Suspensions which can be treated often have solids content of about 5 to 400 g/l, for instance about 100 to 300 g/l.

The composition of the invention may be used in any of the processes of the invention and any of the preferred features described in connection with the process of the invention may be applied to the composition of tie invention.

The invention will now be illustrated with reference to the following examples.

EXAMPLES

Example 1

The anionic surfactant was provided in the form of a 40% solution of dioctyl sulphosuccinate in propylene glycol. 44 lbs of this solution was mixed into a 2,100 US gallon batch of 0.1% solution of an anionic polyacrylamide available under the trade name Percol 336 from Allied Colloids Inc, Suffolk, Virginia. The surfactant solution was added to the anionic polymer solution in the conventional agitated polymer make-up apparatus. The concentration of surfactant in solution was approximately 0.21%. The resultant solution was then dosed into the dilution water being added to the suspension that was obtained as the collective reject fraction from flotation and other separation processes in the recovery of phosphate from phosphate rock in North Carolina and the composition was then subjected to conventional sedimentation conditions in a thickening device.

In normal usage without the addition of the surfactant serious crust formation occurred to form a crust approximately 12 inches thick at the surface of the suspension in the thickening tank. However in the process of the invention the crust was dispersed after about 15 minutes and no further solid material was formed at the surface of the suspension in the thickening tank.

Example 2

The invention was applied to a process similar to Example 1, in which a clay slurry, created as the collective reject fraction from the process of recovering phosphate from phosphate rock in Florida, was discharged to a clay settling lagoon with a surface area of approximately 550 acres. In this settling area surface solids and foam tended to form across an area of approximately 100 acres.

The surfactant solution used in Example 1 was added to a 0.5% solution of Percol 336. Surfactant solution as used in Example 1 was added to 750 gallons of polymer solution at a rate of about 0.3 gallons per minute for approximately 5 minutes. The final active content of surfactant in the polymer solution was about 0.08%. Mixing was carried out in a standard polymer make-up tank. The solution was then added to the clay slurry at a dosage of approximately 0.375 lbs active polymer and 0.06 lbs active surfactant per ton of clay.

After two days of treatment the 100 acres of floating material was dispersed. The polymer consumption was eventually reduced by about 10 to 15% in comparison with the process carried out without use of surfactant.

I claim:

1. A process in which suspended solids in a mineral suspension are flocculated by adding to the suspension a flocculating agent and the flocculated suspension is then subjected to a sedimentation process, and in which surface solids formation during the sedimentation process is reduced or eliminated by adding surfactant to the suspension before or simultaneously with the flocculating agent, provided that the flocculating agent and surfactant are not counter-ionic.

2. A process according to claim 1 in which the flocculating agent is anionic and the surfactant is anionic.

3. A process according to claim 1 in which the surfactant is a dialkyl sulphosuccinate.

4. A process according to claim 3 wherein each alkyl group contains 6 to 12 carbon atoms.

5. A process according to claim 1 in which the surfactant is anionic and comprises dioctyl sulphosuccinate.

6. A process according to claim 1 in which the flocculating agent and the surfactant are added to the suspension simultaneously.

7. A process according to claim 1 in which the flocculating agent and the surfactant are added to the suspension as a single solution in water.

8. A process according to claim 7 in which the concentration of flocculating agent in the solution is from 0.01 to 5% and the concentration of surfactant in the solution is from 0.005 to 2%.

9. A process according to claim 1 in which the mineral suspension is one obtained during the recovery of phosphate from phosphate ore.

10. A process according to claim 1 in which the mineral suspension is formed from a combined reject fraction including wash water from a flotation process.

11. A process according to claim 1 in which the suspended solids comprise clay.

12. A process according to claim 1 in which the mineral suspension is a suspension formed from a combined reject fraction obtained in the separation of clay from phosphate values in a phosphate recovery process.

13. A process according to claim 1 in which the addition of surfactant reduces or eliminates the formation of a crust at the surface of the suspension.

14. A separation process for a mineral suspension containing suspended solids comprising:

a) adding a flocculating agent to the mineral suspension; and b) allowing the resulting mineral suspension to sediment, wherein wherein a dialkyl sulphosuccinate is added to the mineral suspension before or simultaneously with the flocculating agent in order to reduce or eliminate surface solids formation during sedimentation, and wherein the flocculating agent and surfactant are not counter-ionic.

15. A separation process according to claim 14 wherein each alkyl group of the dialkyl sulphosuccinate contains 6 to 12 carbon atoms.

16. A separation process according to claim 14 wherein the dialkyl sulphosuccinate comprises dioctyl sulphosuccinate.

* * * * *